US008170220B2

(12) United States Patent
Mori

(10) Patent No.: US 8,170,220 B2
(45) Date of Patent: May 1, 2012

(54) IMAGE SENSING APPARATUS WITH SELECTABLY COMBINABLE MICROPHONE SIGNALS TO OBTAIN DESIRED DIRECTIVITY

(75) Inventor: Hiroyuki Mori, Mitaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 1257 days.

(21) Appl. No.: 11/859,129

(22) Filed: Sep. 21, 2007

(65) Prior Publication Data

US 2008/0075298 A1 Mar. 27, 2008

(30) Foreign Application Priority Data

Sep. 27, 2006 (JP) ..... 2006-263256

(51) Int. Cl.
*H04R 5/00* (2006.01)
*H04R 3/00* (2006.01)

(52) U.S. Cl. ..... 381/26; 381/92

(58) Field of Classification Search ..... 381/26, 381/92; 367/124, 125, 126
See application file for complete search history.

(56) References Cited

U.S. PATENT DOCUMENTS 4,072,821 A * 2/1978 Bauer ..... 381/23
5,675,655 A * 10/1997 Hatae ..... 381/26
6,950,528 B2 * 9/2005 Fischer ..... 381/92

FOREIGN PATENT DOCUMENTS

JP 2002-232988 8/2002

* cited by examiner

*Primary Examiner* — Vivian Chin
*Assistant Examiner* — Kile Blair
(74) *Attorney, Agent, or Firm* — Cowan, Liebowitz & Latman, P.C.

(57) ABSTRACT

Provided is an image sensing apparatus in which directivity can be changed in accordance with the position of the shooter. The image sensing apparatus includes a video shooting unit, at least four microphones placed around the video shooting unit, and an audio signal processing unit adapted to synthesize audio signals from two microphones among the at least four microphones, thereby outputting a synthesized audio signal from a specific direction of the video shooting unit. The apparatus further includes a selecting unit adapted to select the position of a shooter. The audio signal processing unit includes a directivity changeover unit adapted to change over directivity by changing a combination of the two microphones in accordance with a selection output signal the said selecting unit.

4 Claims, 8 Drawing Sheets

IMAGE SENSING APPARATUS WITH SELECTABLY COMBINABLE MICROPHONE SIGNALS TO OBTAIN DESIRED DIRECTIVITY

BACKGROUND OF THE INVENTION

1. Field of the Invention

The present invention relates to recording of audio in an image sensing apparatus. More particularly, the invention relates to a technique for reliably recording audio that is to be recorded.

2. Description of the Related Art

When a conventional image sensing apparatus records audio from the rear of the apparatus, shooting is not performed with an awareness of the position of the shooter. Consequently, audio such as the voice of the shooter combines with rearward audio that is to be recorded. The result is that the audio desired cannot be recorded well (see Japanese Patent Laid-Open No. 2002-232988).

With an image sensing apparatus that is capable of shooting while capturing audio from the front and audio from the rear simultaneously, the audio from the rear has a major influence depending upon the position of the shooter. Further, the voice of the shooter at the rear of apparatus is readily picked up and is likely to have a significant influence on the audio desired to be captured.

In order to minimize the influence of the shooter, it is necessary to enable the recording of rearward audio with improved realism by changing the directivity of a rear microphone depending upon the position of the shooter, reducing the influence of the voice of the shooter and make possible the gathering of audio originally desired to be captured.

SUMMARY OF THE INVENTION

The present invention enables directivity of an image sensing apparatus to be changed in accordance with the position of the shooter operating the apparatus.

According to one aspect of the present invention, the foregoing problem is solved by providing an image sensing apparatus having a video shooting unit, at least four microphones placed around the video shooting unit, and an audio signal processing unit adapted to synthesize audio signals from two microphones among the at least four microphones, thereby outputting a synthesized audio signal from a specific direction of the video shooting unit, the apparatus further comprising a selecting unit adapted to select the position of a shooter, wherein the audio signal processing unit includes a directivity changeover unit adapted to change over directivity by changing a combination of the two microphones in accordance with a selection output signal from the selecting unit.

According to one aspect of the present invention, the foregoing problem is solved by providing a method of controlling an image sensing apparatus having a video shooting unit and at least four microphones placed around the video shooting unit, the method comprising the steps of combining audio signals from two microphones among the at least four microphones, thereby outputting a synthesized audio signal from a specific direction of the video shooting unit, and selecting the position of a shooter, wherein the step of outputting the synthesized audio signal has a step of changing over directivity by changing a combination of the two microphones in accordance with a selection output signal of the step of selecting the position of the shooter.

Further features of the present invention will become apparent from the following description of exemplary embodiments with reference to the attached drawings.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
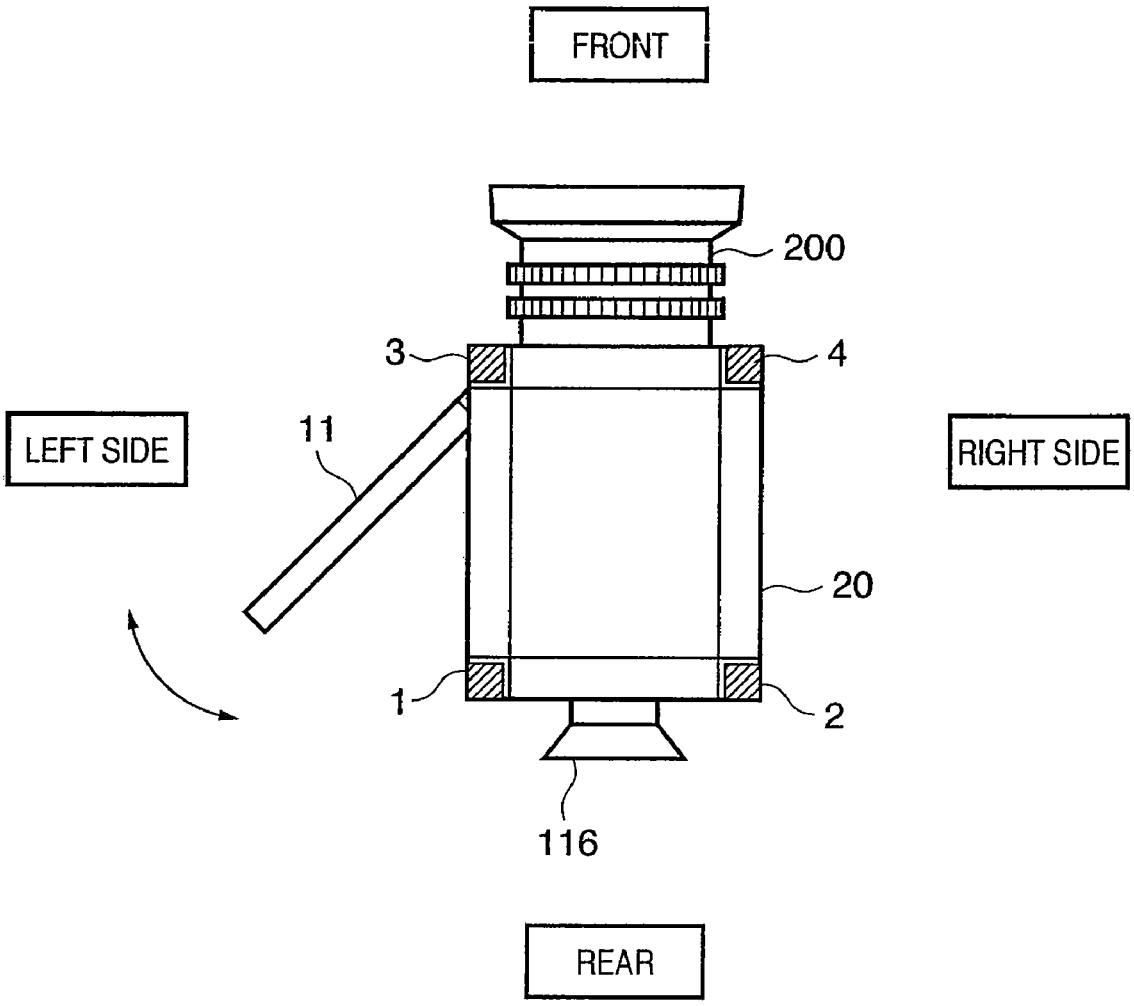
FIG. 1 is a top view of an image sensing apparatus to which the present invention is applicable.
Figure 2:
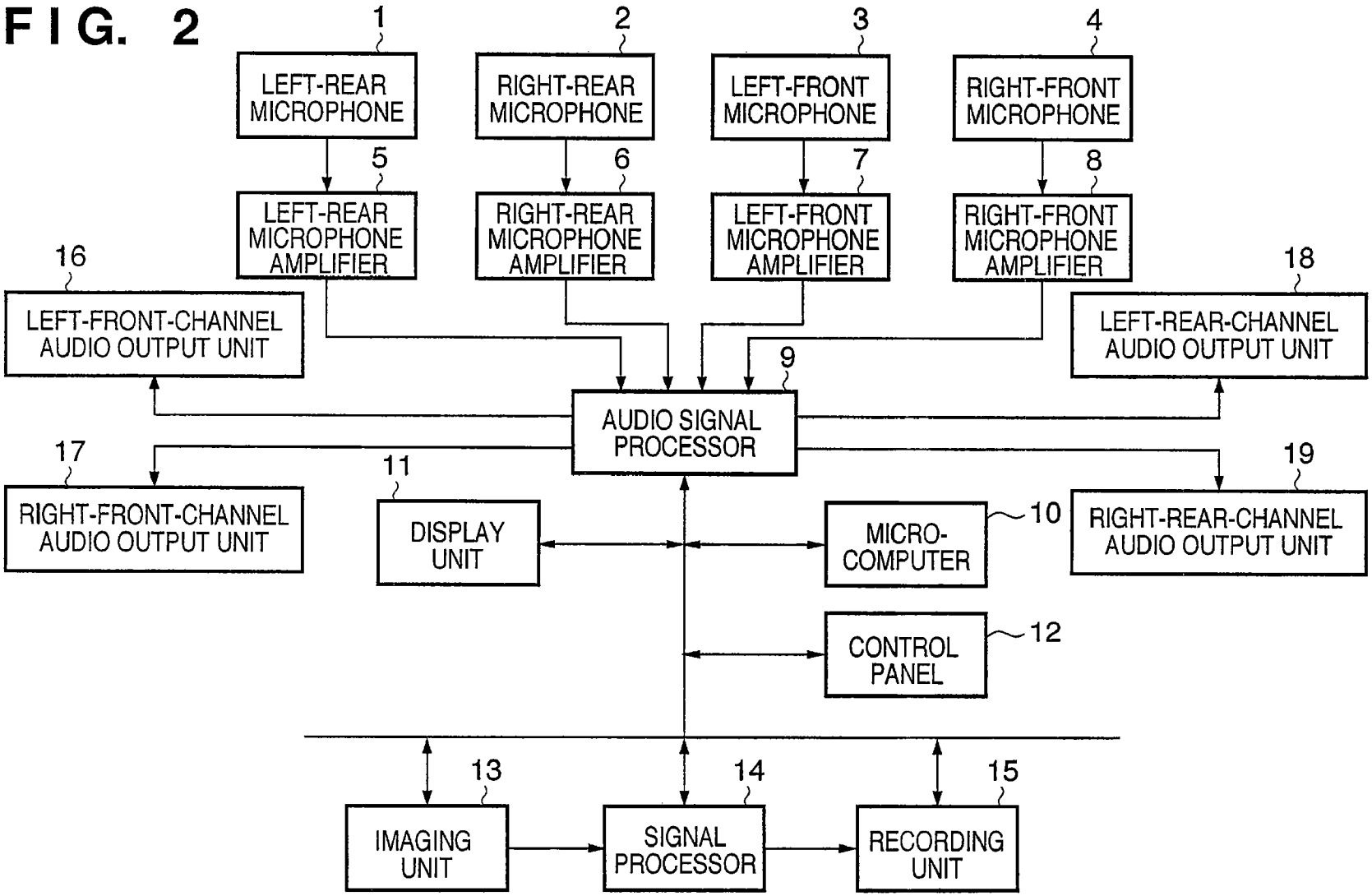
FIG. 2 is a functional block diagram of an image sensing apparatus to which the present invention is applicable.

FIG. 1 is a top view of an image sensing apparatus 20 in a first embodiment to which the present invention is applied. The image sensing apparatus 20 has four microphones for recording four channels of audio. FIG. 2 is a circuit block diagram of the image sensing apparatus 20. As shown in FIG. 1, the image sensing apparatus 20 is equipped with four microphones 1 to 4. Specifically, a left-front microphone 3 and a right-front microphone 4 are mounted on the left front and right front, respectively, of the image sensing apparatus 20, and a left-rear microphone 1 and a right-rear microphone 2 are mounted on the left rear and right rear, respectively, of the image sensing apparatus 20.

The image sensing apparatus 20 has a lens 200, a viewfinder 116 and a display unit 11, as is well known. The display unit 11 is provided on the side of the image sensing apparatus 20 in freely openable and closable fashion and is constituted by an LCD panel that displays video at shooting and playback. FIG. 2 illustrates the circuit block of the image sensing apparatus 20 and illustrates in particular the details of audio processing relating to the embodiment of the invention. As illustrated in FIG. 2, the outputs of the microphones 1, 2, 3 and 4 are supplied to an audio signal processor 9, which is included in the image sensing apparatus 20, via a left-rear microphone amplifier 5, right-rear microphone amplifier 6, left-front microphone amplifier 7 and right-front microphone amplifier 8, respectively.

A microcomputer 10 has an internal CPU and controls the image sensing apparatus 20. The microcomputer 10 is used in implementing each of the embodiments of the invention. The image sensing apparatus 20 further includes a control panel 12, an imaging unit 13, a signal processor 14 and a recording unit 15. A video signal obtained by shooting is recorded on a recording medium such as magnetic tape, an magneto-optic disk or semiconductor memory in the recording unit 15. Not only a video signal but also an audio signal is recorded, the latter at the same time as the video signal.

The display unit 11 in FIG. 2 is the above-mentioned display unit 11 provided on the side of the image sensing apparatus 20 of FIG. 1 in freely openable and closable fashion. The audio signal processor 9 has a left-front-channel audio output unit 16, a right-front-channel audio output unit 17, left-rear-channel audio output unit 18 and a right-rear-channel audio output unit 19. The outputs of these units are multiplexed as necessary and are recorded on a recording medium (not shown) together with the related video signal in the recording unit 15.

Figure 3:
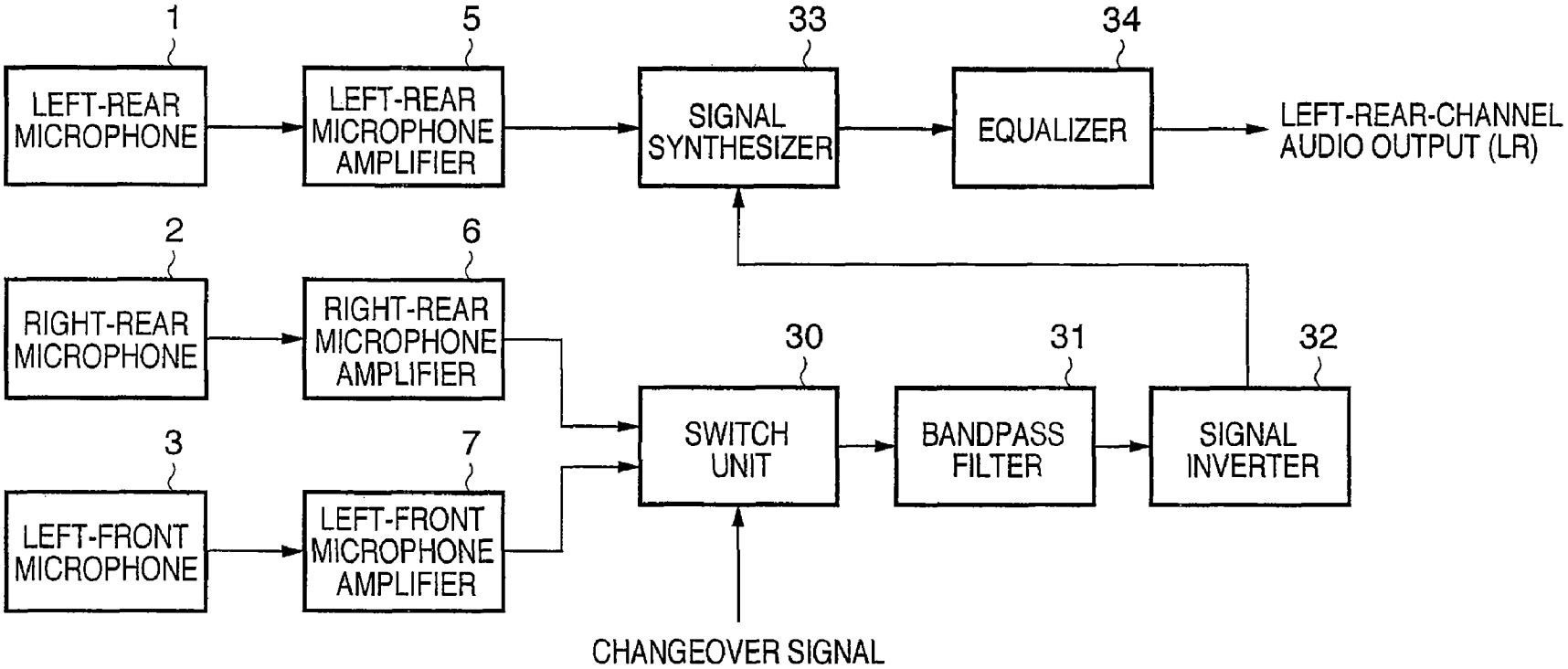
FIG. 3 is a functional block diagram illustrating the generation of left-rear-channel audio to which a first embodiment of the invention is applied.

FIG. 3 is a functional block diagram illustrating a circuit for generating left-rear-channel audio. This is one of the rear-channel audio output units in the audio signal processor 9 of FIG. 2. In FIG. 3, a switch unit 30 switches between the output of the right-rear microphone amplifier 6 and the output of the left-front microphone amplifier 7 of FIG. 2, and a bandpass filter (BPF) 31 extracts a frequency band that emphasizes the stereophonic ambience of the audio output signal of the switch unit 30. A signal inverter 32 inverts the signal from the bandpass filter 31, a signal synthesizer 33 adds the output of the left-rear microphone amplifier 5 and the output of the signal inverter 32, and an equalizer 34 corrects the frequency band attenuated by the signal synthesizer 33. Accordingly, a left-rear-channel audio output (LR output) is obtained from the circuit for generating left-rear-channel audio.

Figure 4:
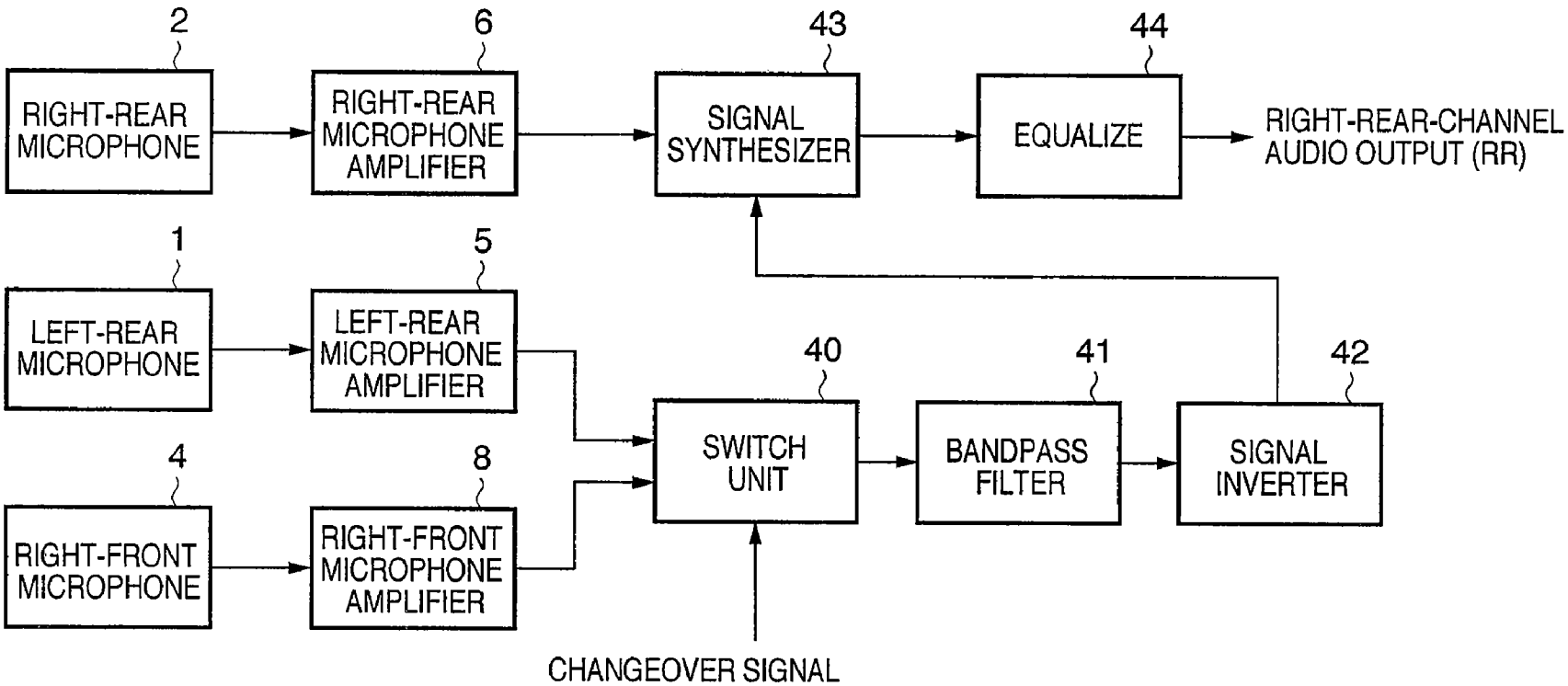
FIG. 4 is a functional block diagram illustrating the generation of right-rear-channel audio to which a first embodiment of the invention is applied.

FIG. 4 is a functional block diagram illustrating a circuit for generating right-rear-channel audio. This is one of the rear-channel audio output units in the audio signal processor 9 of FIG. 2. In FIG. 4, a switch unit 40 switches between the output of the left-rear microphone amplifier 5 and the output of the right-rear microphone amplifier 6 of FIG. 2, and a bandpass filter (BPF) 41 extracts a frequency band that emphasizes the stereophonic ambience of the audio output signal of the switch unit 40. A signal inverter 42 inverts the signal from the bandpass filter 41, a signal synthesizer 43 adds the output of the right-rear microphone amplifier 6 and the output of the signal inverter 42, and an equalizer 44 corrects the frequency band attenuated by the signal synthesizer 43. Accordingly, a right-rear-channel audio output (RR output) is obtained from the circuit for generating right-rear-channel audio.

The audio signal processor 9 also including circuits for generating left-front- and right-front-channel audio outputs. However, since these circuits are not directly related to the working of the present invention, a description thereof will be omitted without illustration.

Figure 5:
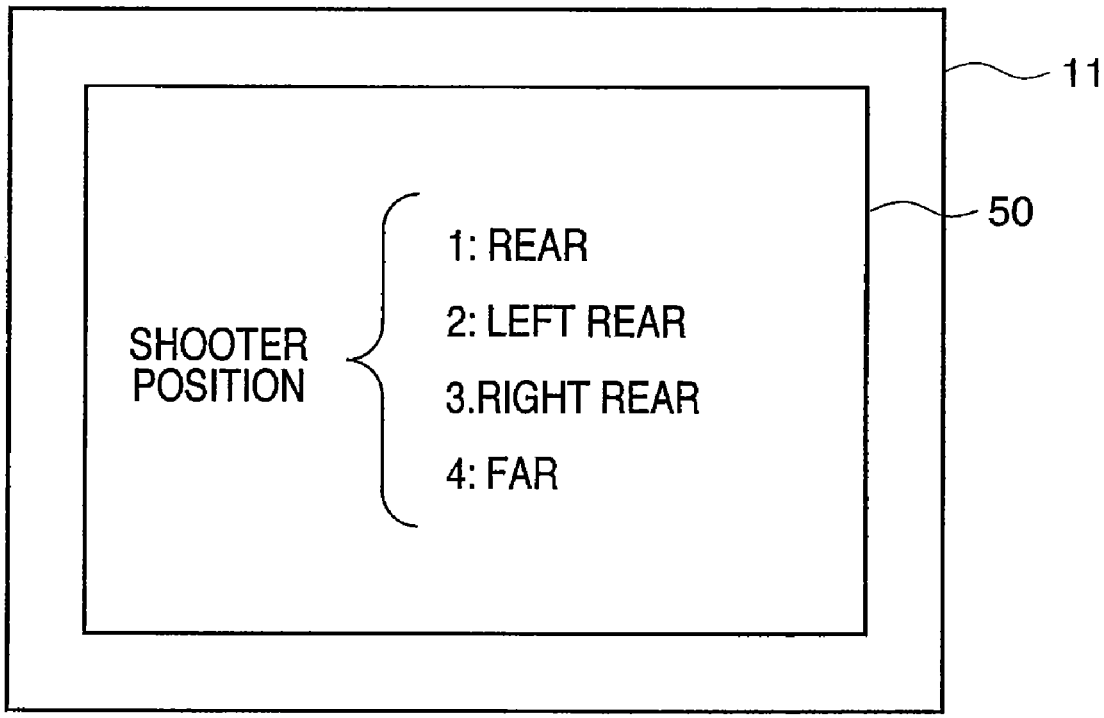
FIG. 5 is a diagram illustrating an example of a display in a case where a shooter selects shooter position in the first embodiment of the invention.
Figure 6:
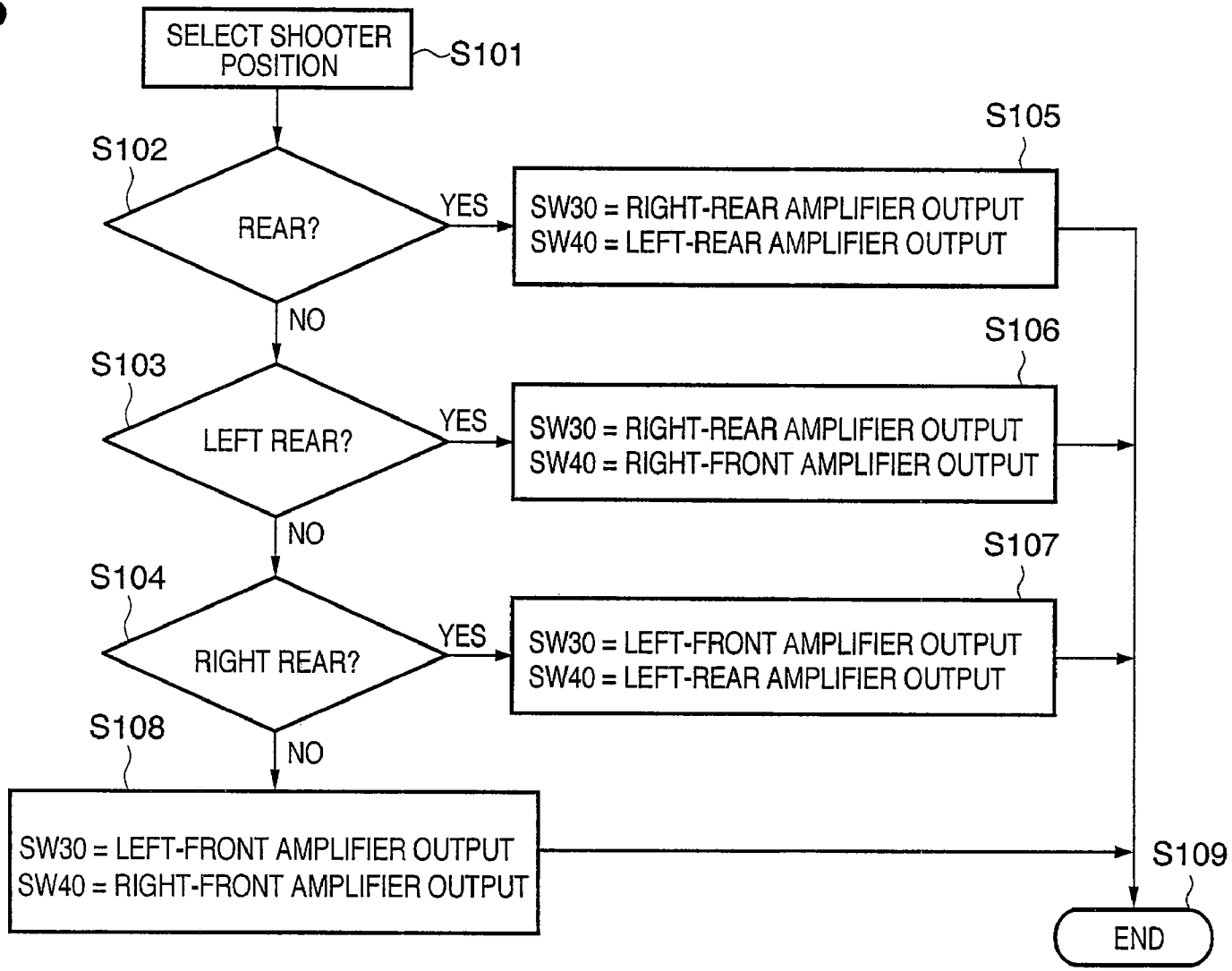
FIG. 6 is a flowchart for describing the operation of the image sensing apparatus to which the first embodiment of the invention is applied.

FIG. 5 illustrates an example of a display presented on the display unit 11 of FIGS. 1 and 2 when the shooter selects the shooter position. FIG. 6 is a control flowchart for describing the operation of the image sensing apparatus 20 according to a first embodiment of the present invention.

The operation of the various components will be described with reference to the drawings. In the image sensing apparatus 20 provided with the four microphones 1 to 4, as illustrated in FIG. 2, audio collected by each of the microphones 1 to 4 is changed to an electric signal. The audio signals are input to the audio signal processor 9 via the respective left-rear microphone amplifier 5, right-rear microphone amplifier 6, left-front microphone amplifier 7 and right-front microphone amplifier 8. A display image 50 serving as a user interface shown in FIG. 5 is displayed on the display unit 11 at this time.

While viewing the display image 50, the shooter operates the control panel 12 and selects his own position or the present position, as indicated at step S101 in FIG. 6. The position information selected by operating the control panel 12 of FIG. 1 is sent to the microcomputer 10, which proceeds to control the audio signal processor 9 in accordance with this position information.

When processing for selecting the position of the shooter is started at step S101, the microcomputer 10 determines the shooter selection at step S102. That is, if the shooter selects "1. REAR" by operating the control panel 12 while viewing the display image 50 of FIG. 5, then the switch unit 30 selects the output of the right-rear microphone amplifier 6 at step S105. If the shooter selects "2. LEFT REAR" at step S103, then the switch unit 30 selects the output of the right-rear microphone amplifier 6 at step S106. If the shooter selects "3. RIGHT REAR" at step S104, then the switch unit 30 selects the output of the left-front microphone amplifier 7 at step S107.

If the shooter makes a selection other than these, i.e., if the shooter selects "4. FAR", then the switch unit 30 similarly selects the output of the left-front microphone amplifier 7 at step S108. Control proceeds to step S109, where processing is exited, from steps S105, S106, S107, S108.

The output signal thus selected is applied to the bandpass filter 31 shown in FIG. 3. The bandpass filter 31 extracts only the frequency band for which stereophonic enhancement is desired, and the extracted signal is inverted by the signal inverter 32. The signal synthesizer 33 adds the output signal of the left-rear microphone amplifier 5 (this signal is the original signal) and the output signal of the signal inverter 32. The output signal of the signal synthesizer 33 produced by this addition is obtained as the left-rear-channel audio output (LR output) via the equalizer 34. This output is delivered to the left-rear-channel audio output unit 18 of FIG. 1.

Similarly, if the shooter selects "1. REAR" at step S102, then the switch unit 40 selects the output of the left-rear microphone amplifier 5 at step S105. If the shooter selects "2. LEFT REAR" at step S103, then the switch unit 40 selects the output of the right-front microphone amplifier 8 at step S106. If the shooter selects "3. RIGHT REAR" at step S104, then the switch unit 40 selects the output of the left-rear microphone amplifier 5 at step S107.

If the shooter makes a selection other than these, i.e., if the shooter selects "4. FAR", then the switch unit 40 similarly selects the output of the right-front microphone amplifier 8 at step S108. Control proceeds to step S109, where processing is exited, from steps S105, S106, S107, S108. The output signal thus selected is applied to the bandpass filter 41 shown in FIG. 4. The bandpass filter 41 extracts only the frequency band for which stereophonic enhancement is desired, and the extracted signal is inverted by the signal inverter 42. The signal synthesizer 43 adds the output signal of the right-rear microphone amplifier 6 (this signal is the original signal) and the output signal of the signal inverter 42. The output signal of the signal synthesizer 43 produced by this addition is obtained as the right-rear-channel audio output (RR output) via the equalizer 44. This output is delivered to the right-rear-channel audio output unit 19 of FIG. 1.

Thus, the directivity characteristic is changed in accordance with the selection of the position of the shooter, whereby the left-rear-channel audio output (LR output) and right-rear-channel audio output (RR output) are obtained.

In this embodiment, basically non-directional microphones are used as the four microphones 1 to 4. However, it is also possible to work the present invention by using directional microphones and combining them while taking their directivity into consideration. Further, although four microphones are used in the first embodiment, it is also possible to work the present invention using more than four microphones.

Second Embodiment

Figure 7:
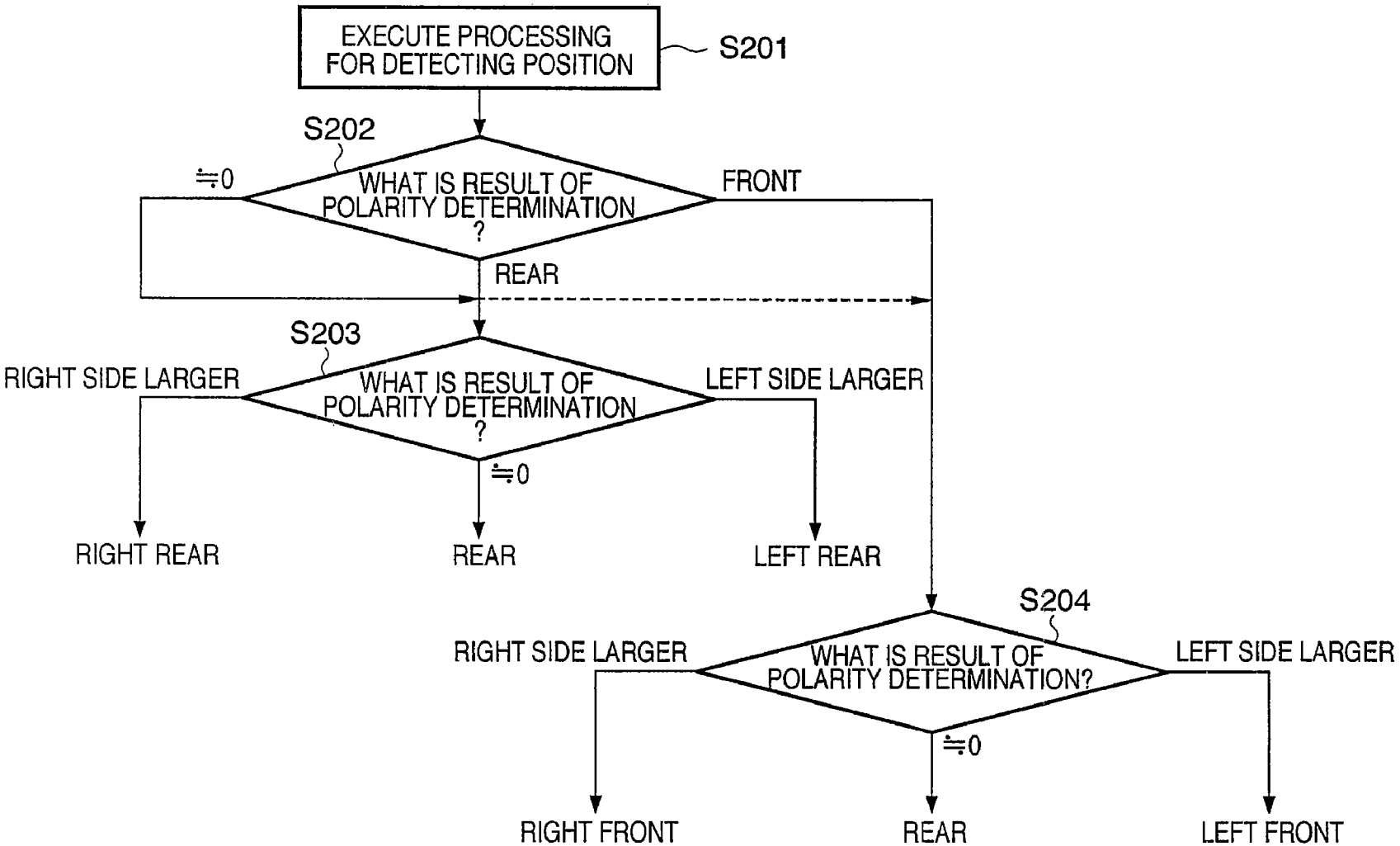
FIG. 7 is a flowchart for describing the operation of the image sensing apparatus to which a second embodiment of the invention is applied.
Figure 8:
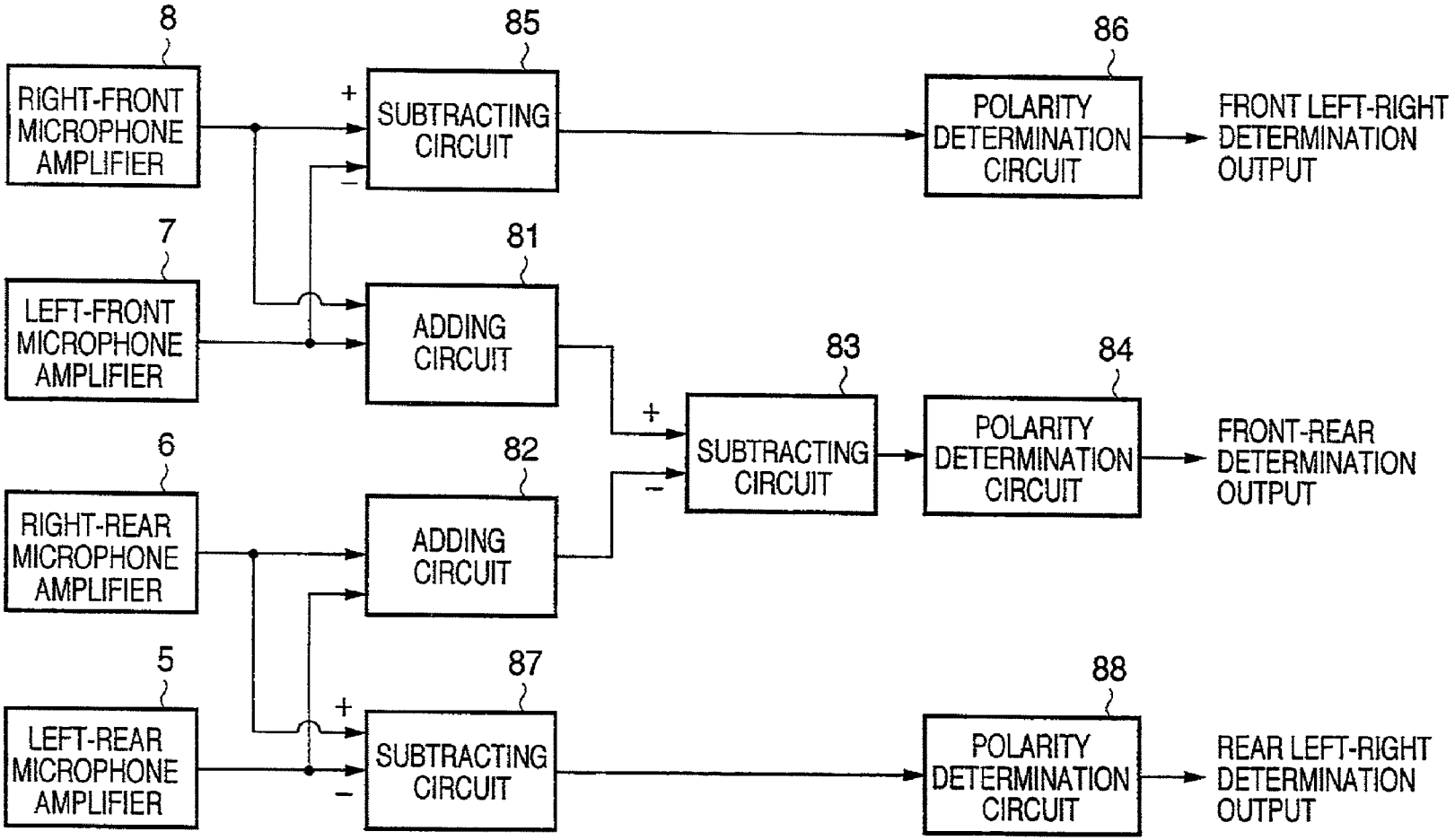
FIG. 8 is a functional block diagram illustrating processing for automatically determining the position of a shooter to which the second embodiment of the invention is applied.

In the first embodiment, the position at which the shooter is standing is set by an operation performed by the shooter. In a second embodiment, the setting of shooter position is automated. FIG. 7 is a flowchart for describing the operation of the second embodiment. FIG. 8 is a functional block diagram illustrating processing for automatically determining the position of a shooter according to the second embodiment.

Audio signals from the right-front microphone amplifier 8 and left-front microphone amplifier 7 are added by an adding circuit 81, and the audio signals from the right-rear microphone amplifier 6 and left-rear microphone amplifier 5 are added by an adding circuit 82. The added audio signals from the adding circuits 81 and 82 undergo subtraction by a subtracting circuit 83 and the result is applied to a polarity determining circuit 84. Accordingly, if the output of the polarity determining circuit 84 is approximately zero, it can be determined that the position at which the shooter is located is center of front and rear, i.e., a position the same as that of the image sensing apparatus 20 in the front-rear direction. If the output of the polarity determining circuit 84 has a positive polarity, this means that the position is on the front side of the image sensing apparatus 20, and if the output has a negative polarity, this means that the position is on the rear side of the image sensing apparatus 20.

The audio signals from the right-front microphone amplifier 8 and left-front microphone amplifier 7 undergo subtraction in a subtracting circuit 85. The polarity of the output of subtracting circuit 85 is determined by a polarity determining circuit 86. Accordingly, if the output of the polarity determining circuit 86 is approximately zero, it can be determined that the position at which the shooter is located is center of left and right, i.e., a position the same as that of the image sensing apparatus 20 in the left-right direction. If the output of the polarity determining circuit 86 has a positive polarity, this means that the position is on the right-front side of the image sensing apparatus 20, and if the output has a negative polarity, this means that the position is on the left-front side of the image sensing apparatus 20.

Similarly, the audio signals from the right-rear microphone amplifier 6 and left-rear microphone amplifier 5 undergo subtraction in a subtracting circuit 87. The polarity of the output of subtracting circuit 87 is determined by a polarity determining circuit 88. Accordingly, if the output of the polarity determining circuit 88 is approximately zero, it can be determined that the position at which the shooter is located is center of left and right, i.e., a position the same as that of the image sensing apparatus 20 in the left-right direction. If the output of the polarity determining circuit 88 has a positive polarity, this means that the position is on the right-rear side of the image sensing apparatus 20, and if the output has a negative polarity, this means that the position is on the left-rear side of the image sensing apparatus 20.

Next, the operation of the means for automatically determining the position of the shooter will be described with reference to FIG. 7 for describing operation. When automatic determination is executed, the processing described below is executed while the shooter issues voice himself or holds an acoustic generator such as a buzzer and generates audio using the generator.

Position detection processing starts at step S201 in FIG. 7. Control then proceeds to step S202, where the front and rear audio signals are compared. This processing is related to the operation of the polarity determining circuit 84. If it is determined that the level of the rear audio signal is greater than that of the front audio signal, control proceeds to step S203, where polarity is determined. The processing of step S203 is related to the operation of the polarity determining circuit 88. By determining polarity in the manner described above, whether the position of the shooter is at the rear, right rear or left rear is determined automatically.

If it is determined at step S202 that the position of the shooter is in front, then control proceeds to step S204 and polarity is determined. The processing of step S204 is related to the operation of the polarity determining circuit 86. By determining polarity in the manner described above, whether the position of the shooter is in front, right front or left front is determined automatically. If the result of the decision at step S202 is approximately zero, polarity is determined using step S203 or step S204 and it is possible to determine whether the position of the shooter is on the left side or right side of the image sensing apparatus 20. In this case, it is also possible to add the outputs of the right-front microphone amplifier 8 and right-rear microphone amplifier 6, add the outputs of the left-front microphone amplifier 7 and left-rear microphone amplifier 5, find the difference between the two sums using a subtracting circuit and make the left-right determination by determining the polarity of the output signal from the subtracting circuit.

The position determination information thus automatically obtained is supplied to the microcomputer 10 in FIG. 1, and the switch units 30 and 40 are changed over automatically. As a result, it is possible to change the combined directivity of the four microphones appropriately so as to reduce the influence of the voice of the shooter located in the rear.

It goes without saying that the object of the invention is attained also by supplying a recording medium storing the program codes of the software for performing the functions of the foregoing embodiments to a system or an apparatus, reading the program codes with a computer (e.g., a CPU or MPU) of the system or apparatus from the recording medium, and then executing the program codes. In this case, the program codes read from the recording medium implement the novel functions of the embodiments and the recording medium storing the program codes constitutes the invention.

Examples of recording media that can be used for supplying the program code are a flexible disk, hard disk, optical disk, magneto-optical disk, CD-ROM, CD-R, magnetic tape, non-volatile type memory card or ROM, etc. There are also cases where the functions of the above-described embodiments are implemented by having a computer execute the read program codes.

However, it goes without saying that the invention also includes a case where an operating system or the like running on a computer performs all or a part of the actual processing based upon the indications in the program codes and the functions of the above-described embodiments are implemented by this processing.

Furthermore, there may also be cases where program code read from a storage medium is written to a memory provided on a function expansion board inserted into the computer or provided in a function expansion unit connected to the computer. Thereafter, a CPU or the like provided on the function expansion board or function expansion unit performs a part of or the entire actual processing based upon the instructions of program codes, and the functions of the above embodiments are implemented by this processing.

In accordance with the present invention, an image sensing apparatus in which directivity can be changed in accordance with the position of the shooter can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-263256, filed Sep. 27, 2006, which is hereby incorporated by reference herein in its entirety.

What is claimed is:

1. An image sensing apparatus comprising:

a video shooting unit;

at least four non-directional microphones placed on a left front side, a right front side, a left rear side and a right rear side to the video shooting unit, of a main body of the video shooting unit;

an audio signal processing unit adapted to output synthesized audio signals of a left rear channel and right rear channel by synthesizing audio signals from two non-directional microphones among the at least four non-directional microphones; and a deciding unit adapted to decide a position of a shooter to the video shooting unit, wherein the audio signal processing unit outputs the synthesized audio signal of the left rear channel by synthesizing the audio signal from the non-directional microphone placed on the left rear side and the audio signal from the non-directional microphone placed on the right rear side and outputs the synthesized audio signal of the right rear channel by synthesizing the audio signal from the non-directional microphone placed on the right rear side and the audio signal from the non-directional microphone placed on the right front side when the deciding unit decides that the position of the shooter is a left rear of the video shooting unit, and outputs the synthesized audio signal of the left rear channel by synthesizing the audio signal from the non-directional microphone placed on the left rear side and the audio signal from the non-directional microphone placed on the left front side and outputs the synthesized audio signal of the right rear channel by synthesizing the audio signal from the non-directional microphone placed on the right rear side and the audio signal from the non-directional microphone placed on the left rear side when the deciding unit decides that the position of the shooter is a right rear of the video shooting unit.

2. The apparatus according to claim 1, wherein the deciding unit includes a display unit and an operation unit, displays a screen for the shooter to select a position of the shooter on the display unit, and decides, as the position of the shooter, a position of the shooter selected in the screen through the operation unit.

3. The apparatus according to claim 1, wherein the deciding unit compares a level of the audio signals from the non-directional microphone placed on the left front side and the non-directional microphone placed on the right front side with a level of the audio signals from the non-directional microphone placed on the right rear side and the non-directional microphone placed on left rear side, in a case where the level of the audio signals from the non-directional microphone placed on the right rear side and the non-directional microphone placed on the left rear side is greater than the level of the audio signals from the non-directional microphone placed on the left front side and the non-directional microphone placed on the right front side, the deciding unit compares a level of the audio signal from the non-directional microphone placed on the right rear side with a level of the audio signal from the non-directional microphone placed on the left rear side, the deciding unit decides that the position of the shooter is the right rear of the video shooting unit when the level of the audio signal from the non-directional microphone placed on the right rear side is greater than the level of the audio signal from the non-directional microphone placed on the left rear side, and the deciding unit decides that the position of the shooter is the left rear of the video shooting unit when the level of the audio signal from the non-directional microphone placed on the right rear side is smaller than the level of the audio signal from the non-directional microphone placed on the left rear side.

4. A method of controlling an image sensing apparatus including a video shooting unit and at least four non-directional microphones placed on a left front side, a right front side, a left rear side and a right rear side to the video shooting unit, of a main body of the video shooting unit, the method comprising:

an audio signal processing step for outputting synthesized audio signals of a left rear channel and right rear channel by synthesizing audio signals from two non-directional microphones among the at least four non-directional microphones; and a deciding step for deciding a position of a shooter to the video shooting unit, wherein in the deciding step, the synthesized audio signal of the left rear channel is output by synthesizing the audio signal from the microphone placed on the left rear side and the audio signal from the microphone placed on the right rear side and the synthesized audio signal of the right rear channel is output by synthesizing the audio signal from the microphone placed on right rear side and the audio signal from the microphone placed on the right front side when it is decided that the position of the shooter is a left rear of the video shooting unit in the deciding step, and the synthesized audio signal of the left rear channel is output by synthesizing the audio signal from the microphone placed on the left rear side and the audio signal from the microphone placed on the left front side and the synthesized audio signal of the right rear channel is output by synthesizing the audio signal from the microphone placed on the right rear side and the audio signal from the microphone placed on the left rear side when it is decided that the position of the shooter is a right rear of the video shooting unit in the deciding step.

* * * * *